US007611111B2

(12) United States Patent
Costa et al.

(10) Patent No.: US 7,611,111 B2
(45) Date of Patent: Nov. 3, 2009

(54) DEVICE REALIZING REMOVABLE BRACKETS, VARIOUSLY ADJUSTABLE AND POSITIONABLE IN THE SENSE OF HEIGHT

(75) Inventors: Francesco Costa, San Daniele del Friuli (IT); Luca Fava, Revine Lago (IT); Luigi Maniago, Arzene (IT); Adriano Pessot, Pordenone (IT); Roberto Santarossa, Porcia (IT)

(73) Assignee: Baron Industries S.r.l., Decimo (IT)

( * ) Notice: Subject to any disclaimer, the term of this patent is extended or adjusted under 35 U.S.C. 154(b) by 0 days.

(21) Appl. No.: 11/797,288

(22) Filed: May 2, 2007

(65) Prior Publication Data

US 2008/0048081 A1 Feb. 28, 2008

(30) Foreign Application Priority Data

May 3, 2006 (IT) ..... PN2006A0031

(51) Int. Cl.
*E04G 5/06* (2006.01)

(52) U.S. Cl. ..... 248/243; 248/244; 108/147.17; 312/408; 211/103

(58) Field of Classification Search ..... 248/243, 248/246, 297.21, 297.31, 422, 423, 407, 248/241, 244, 245; 108/106, 107, 108, 147.11, 108/147.16, 147.17; 312/408; 211/103, 211/187, 190, 207, 90.02, 150
See application file for complete search history.

(56) References Cited

U.S. PATENT DOCUMENTS 3,982,801 A * 9/1976 Heidorn et al. ..... 312/306
5,913,584 A * 6/1999 Swindell et al. ..... 312/408
6,065,821 A * 5/2000 Anderson et al. ..... 312/408

* cited by examiner

*Primary Examiner*—A. Joseph Wujciak, III
(74) *Attorney, Agent, or Firm*—Wenderoth, Lind & Ponack, L.L.P.

(57) ABSTRACT

A device has removable, height-adjustable and positionable shelves. The device includes a pair of vertical struts inside of which suitable brackets of associated boards, can run. The vertical struts, have respective "racks" positioned in a back part of the struts, on which suitable toothed wheels are engaged that are located in a middle part of a rear end of each bracket. A lower end of each bracket a suitable toothed sliding back is located which, when the associated bracket is positioned in a normal horizontal position, i.e., at a right angle to the respective vertical strut, is engaged to a relative portion of the respective rack, but when the bracket is raised by being inclined upwardly at its front part, rotating around the associated toothed wheel, the sliding block is disengaged from the rack, thus being able to run freely vertically along the associated vertical strut. The device also has a related element for limiting the rotation and/or the support of the strut and suitable blocking elements capable of preventing any movement of the shelves.

5 Claims, 6 Drawing Sheets

DEVICE REALIZING REMOVABLE BRACKETS, VARIOUSLY ADJUSTABLE AND POSITIONABLE IN THE SENSE OF HEIGHT

BACKGROUND OF THE INVENTION

1. Field of the Invention

The subject of present invention is a device for realizing removable shelves, which allows quick and at the same time easy positioning, as well as simple adjustment of the height of the boards of the shelving units. The system is comprised of at least two vertical "runners" formed by respective "racks" located inside profiled strips, preferably of aluminium, which can be defined as vertical "struts". Inside the profiled strips and vertical "struts" run moreover the ends of the shelves which can be defined as "brackets" which are equipped with sliding blocks for "catch[es]" and toothed guide wheels for in the vertical movement which properly guide the shelves vertically and constantly maintain them in the horizontal position. Furthermore, once the shelves are positioned, they will be easily fastened by means of the simple action of common screws inside the vertical run grooves in the "struts", the screws being screwed into threaded holes made in the ends or "brackets" of the shelves and proximal to the aforementioned vertical grooves.

2. Description of the Related Art

Vertical shelves are commonly known which are applied to the most varied solutions of interior decorating, commercial applications such as exhibitions, shops, etc., and also applied to electrical household appliances etc. These types of conventional shelves are constituted, for example, of slotted vertical struts into which some type of "arms" are hooked in the known and relatively easy manner which will support the brackets of the shelves. Other solutions consist of shelves that are fastened by various systems of hooking and fastening screws, bolts, etc.

All systems, such as the aforementioned and those noted and not listed for the sake of brevity do meet the requirement of obtaining shelf brackets for shelving units. However, they have at the same time significant limitations as to their utility in so far as, once the height of the bracket of the shelf of the unit has been fixed it can no longer be changed without complex and laborious operations involving disassembly and assembly of supports, hooking systems, being part of the fastening system of the bracket of the shelf of the unit.

From the preceding, it can be gathered not only how difficult it is to adjust the height of the brackets once the have been fastened, but also the functional difficulty of the fastening system and of positioning the boards of the shelving unit. In conclusion, the boards of a shelving unit can certainly be connected to the supporting structure, but once they are fixed, they can be removed only by long and tedious operations which involve considerable loss of time and which, for instance in commercial exhibitions, make it impossible to display the merchandise quickly, thus resulting in economic losses. It is not necessary to dwell any further on the description of the functional and structural limitations of the conventional shelving units and their vertical adjustments, but to state only that the conventional systems, while they are certainly mechanically solid, make it very difficult to vary the height of their brackets once they have been fastened, and such difficult handling involves a considerable amount of effort and time if it is desired to vary the height of the shelving boards, and, as such, labor costs will not be negligible.

SUMMARY OF THE INVENTION

The objective of the present invention is therefore to obviate the inconveniences. This is achieved with a device which is subject to the present invention.

BRIEF DESCRIPTION OF THE DRAWINGS

In order to better understand the characteristics and the advantages of this invention as well as the benefits from the user's and manufacturer's point of view, a preferred form of realization will be described in the following by example, which is not limited to this example, with reference to the attached drawings in which.

DETAILED DESCRIPTION OF THE INVENTION

In the aforementioned figures common items are identified by the same references.

Figure 1:
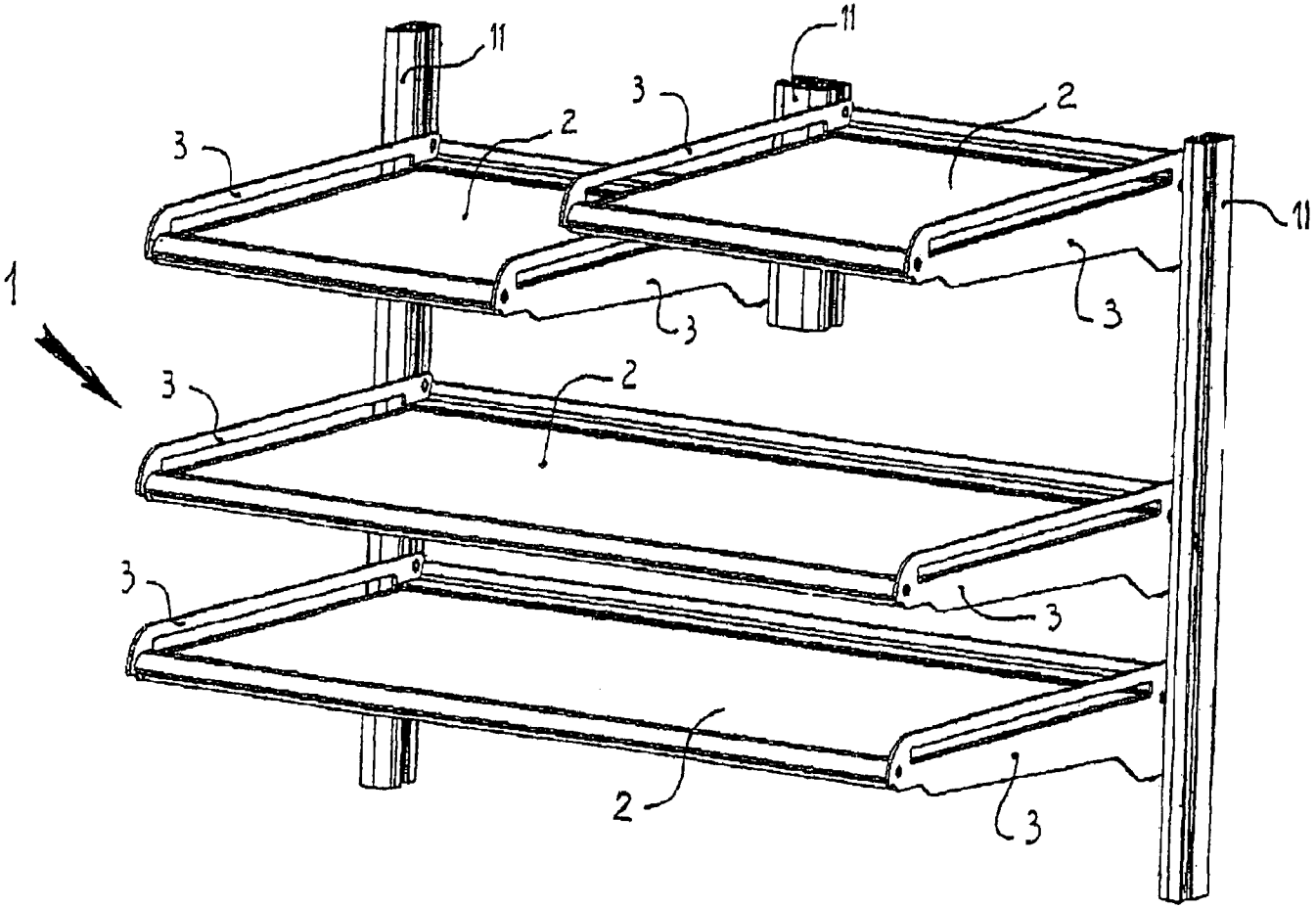
FIG. 1 shows a perspective view of the complete device.

With particular reference to the FIG. 1, it will be noticed that it shows the device 1 for height adjustment of the shelf brackets complete with all its parts can for the sake of simplicity be called the "shelving unit". The device 1 basically is comprised of a pair of guide "struts" 11, obtained from a profiled strip preferably of aluminium with a suitably conforming section (the conformance of the profile is not described as can be with profiles commonly available on the market) for purpose of accommodating the devices for moving, adjusting and blocking the shelves 2 which will engage with said associated brackets 3 in the guide "struts" 11. FIG. 1 also shows that with the system it is possible to realize boards 2 of separate shelves by using a double guide "strut" 11 having a different vertical measurement inside the pair of external guide "struts" 11.

Figure 2:
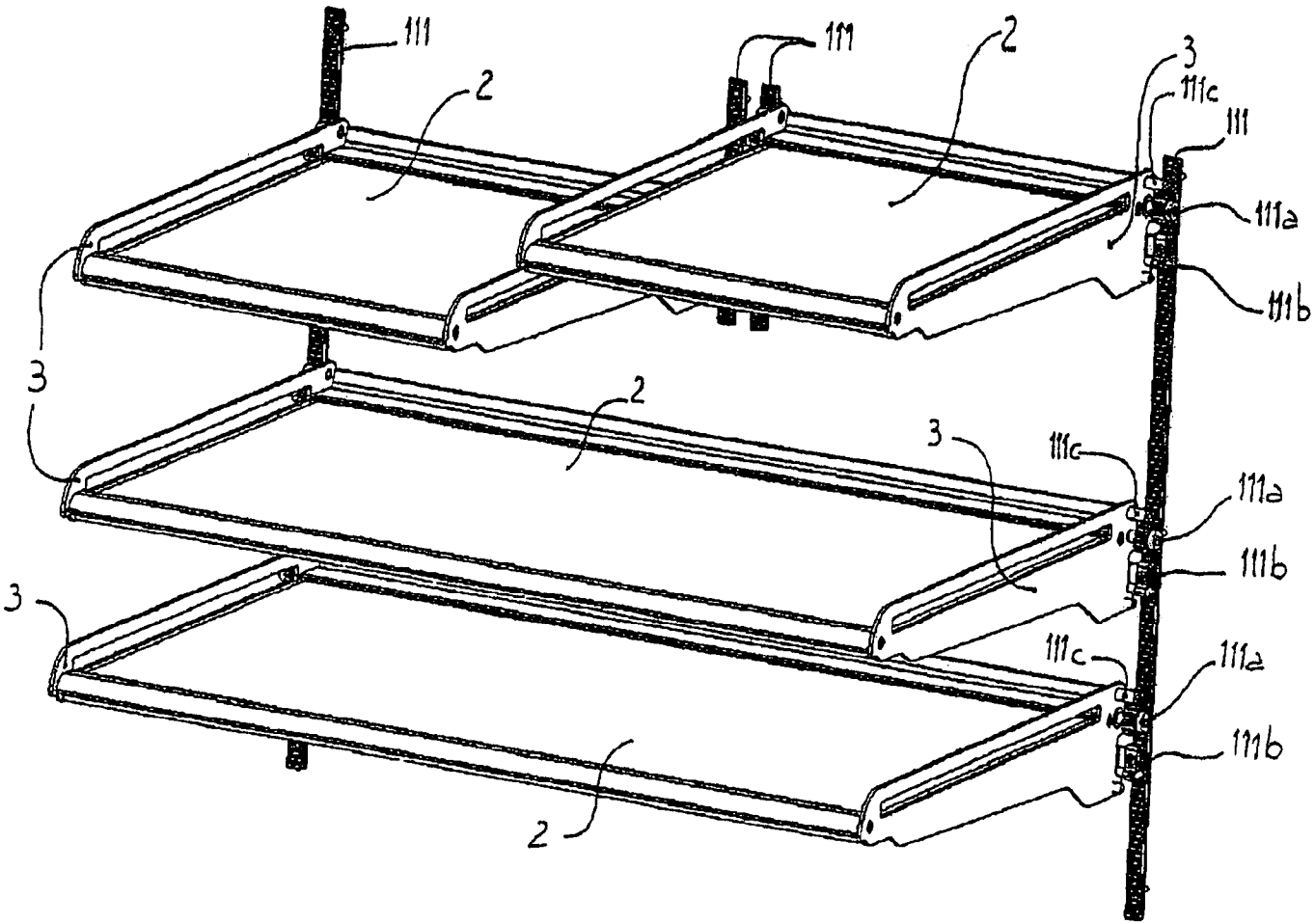
FIG. 2 is the same view as FIG. 1, depicting the device for adjusting the height of the shelf brackets of the shelving units.

In FIG. 2 are shown the particular items inserted into the guide "struts" 11 of FIG. 1, and evident are specifically two toothed vertical elements 111 assimiliable to form a vertical "rack", which perform in cooperation with other particular items shown hereafter, a height-adjusting action and, consequently, the action of positioning of the boards 2 of the shelves.

Furthermore, still as shown in FIG. 2, will be noticed the toothed guide wheel 111*a* in a vertical translation and in the rotation of the brackets 3, the toothed sliding block 111*b*, for locking the "bracket" fixedly connected with the board of the shelf unit 2 in the position desired by the operator. In the following FIGS. 3, 4 and 5 the various items described above can be seen not only with greater precision, but also with other important items for the movement of the board 2 of the shelving unit. As a matter of fact, the figures are vertical section views of the guide struts 11. These figures show a "small stop" 111*c* in the rotation of "bracket" 3 within the vertical grooves of the guide "struts" 11, which is joined and fixed with the board 2 of the shelf unit, and a hole 111*d* for the accommodation of a known and not described or shown screw and provided with a knob 111*e*, shown in FIG. 6, which can be turned in both directions of the threading to tighten or loosen the screw joined to it, blocking and unblocking the rotation of the bracket 3/board 2 assembly of the shelving unit for the respective vertical movements.

For further clarity, it is emphasized that the toothed vertical guide, for the sake of brevity is defined as the "rack" 11, which is inserted into the back part of the guide "strut" 11 which forms the vertical "struts" 11 of the device forming the shelving unit". With reference to FIGS. 2, 3, 4 and 5, it is clear that the toothed wheel 111*a*, with its rotation pin, the "sliding block" 111*b*, as well as the small stop 111*c* are all fixed with the plane surface of the bracket 3 in the bracket's 3 preferred back area next to the "racks" 111 and is then inserted internally in the vertical strut 11 comprised, as previously stated, of a strip of extruded profile, preferably aluminium.

Figure 4:
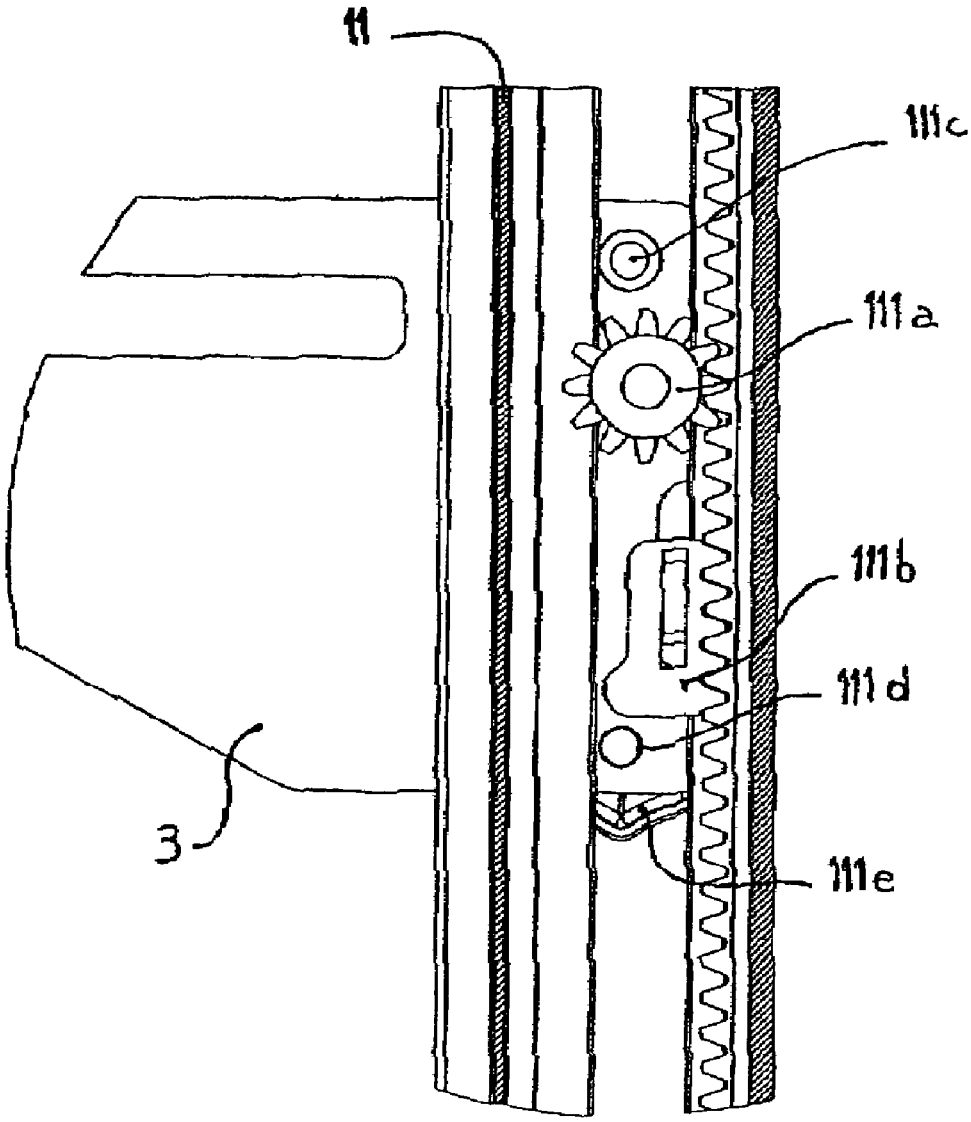
FIG. 4 is a side view of the engagement and fastening system of the subject device in the fastening position on the vertical struts.
Figure 5:
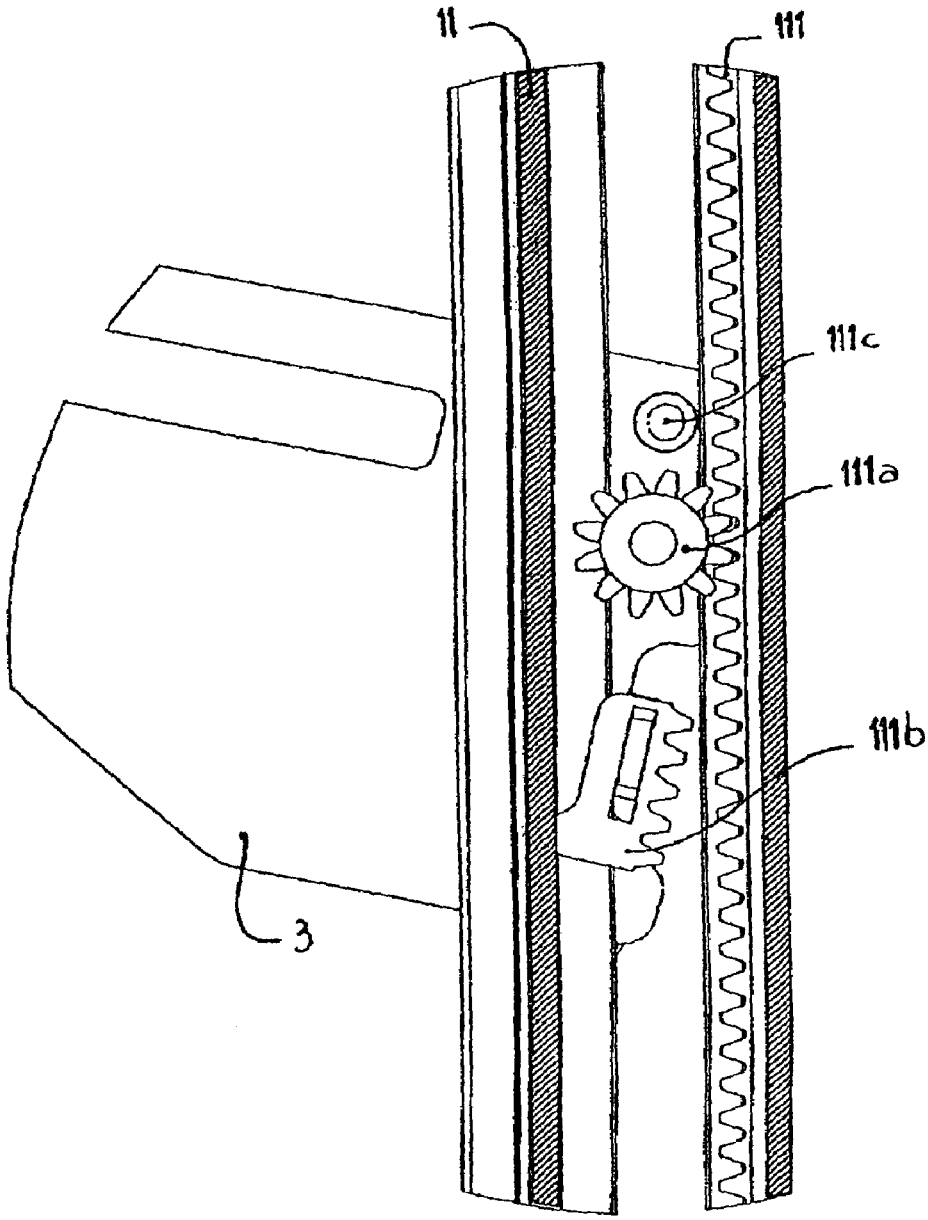
FIG. 5 is a side view of the system, like FIG. 4, but depicting the disengaged and hence freely movable and positionable device.

To the above explanation must be added that, still in accordance with FIGS. 3, 4 and 5, there is also shown a hole 111*d* for receiving a not described screw of known type which will function like a "block" to prevent any accidental movement of the board as described below.

Figure 3:
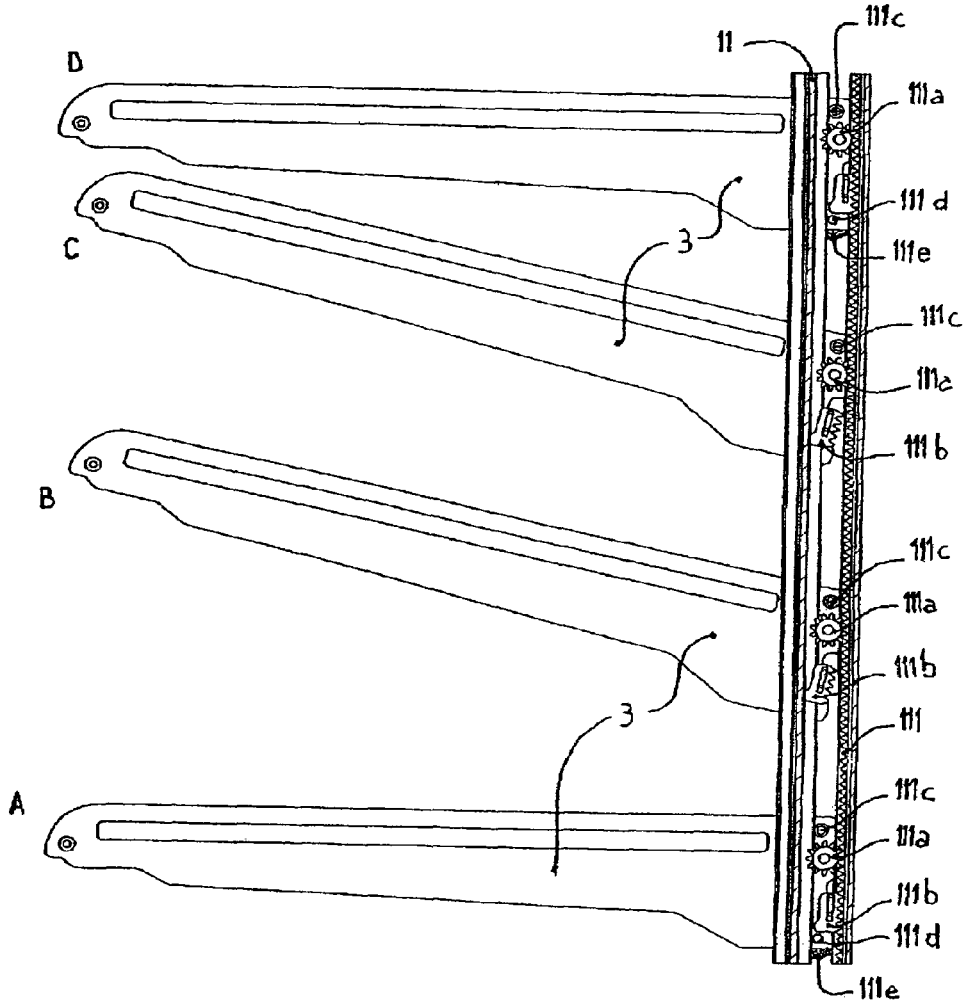
FIG. 3 is a side view of the device depicting the various sequences of positioning a bracket from an initial first position to a desired second and final position.

In fact, FIG. 3 shows the various phases of the movement of the boards of the shelving units 2, moving from a position A through two intermediate positions B and C until they reach the final position D which is identical with the initial position A.

With particular reference to FIG. 3, which describes the various phases of vertical movement of the shelves 2 of the shelving unit as described above and in consequence to the remaining FIGS. 4 and 5, the following becomes clear.

In the position A, the board of the shelving unit 2, fixedly connected with the bracket 3 and not visible, will be in the "blocked" position with the toothed sliding block 111*b* through connection of its teeth with the corresponding teeth of the vertical guide called the "rack" 111, with some of the teeth of the toothed wheel 111*a* still being engaged with the teeth of the "rack" 111 and stopped, thus no longer in rotation. The small stop 111*c* will be pushing on the vertical plane of the groove of the strut 11 to balance out the weight due to the shelf unit and will maintain it in the desired position. In this first position A, the screw corresponding to the knob 111*e* of FIG. 6 will be turned in order to effect its insertion into the space inside the vertical guide strut 11, to ensure the blocking of the moving system 1 of the shelf boards. The corresponding screw for the knob 111*e* will subsequently be loosened thereby freeing the aforementioned kinetic motion, passing to the second phase.

In position B of the board 2 of the unit, not visible, but fixedly connected with the "bracket" 3 and the "bracket" 3 itself is then rotated around the axis of the rotation of the toothed wheel 111*a*, after unblocking, as described above, the screw inserted in the threaded hole 111*d* and fixed with the knob 111*e*. The rotation of the bracket 3, fixedly with the board 2, involves the disengagement of the "sliding block 111*b* from the "rack" 111 and the displacement of the "small stop" 111*c* from a position of resistance to the weight of the shelf unit (comprised of the brackets and the board 2) to a "limit" position of rotation inside the vertical space of the guide strut 11. This position prevents the excessive rotation of the boards 2 and of the brackets 3, assisted also by the "sliding block" 111*b* which, with one of its components opposite to its toothed part, strikes against the part of the vertical cavity of the guide strut 11 where it previously has been striking against the "small stop" 111*c*. It will also be noticed that the toothed wheels 111*a* function as a guide for the vertical movement, or rather they always maintain, during the movement, the shelf unit comprised of the board 2 and the "brackets" 3 in the horizontal position.

At this point the elevation of the shelf unit continues, passing through the position C, pointing out again the inclined "brackets" 3 and through all intermediary positions to it, be they preceding or following, until position D is reached.

The position D depicts, like the position A, the "bracket" 3 with its associated board 2, not visible, placed horizontally at a particular and desired height. In the final position D, in order to make the entire arrangement firm and to prevent the possible involuntary movement of the boards 2 of the shelf units and thus of the entire kinematic motion associated with the "brackets" 3 etc., the knob equipped with a known screw is placed in the threaded hole 111*d* inside the vertical space of the vertical strut 11. Thus, concluding the phase height adjustment of the boards 2 of the shelving units which is obtained by moving away from a stable position for the boards 2 of the shelving units and succeeding in obtaining a second position of the boards 2 that is equally stable and secure.

Incidentally, it is pointed out that the movement can clearly be vertical whether in the upward or downward direction. The blocking and unblocking phases are shown further down in FIGS. 4 and 5, with FIG. 4 showing precisely the kinematic motion with all of the particulars of movement and positioning previously described in a "blocking" phase, whereas FIG. 5 shows the same kinematic motion in an "unblocking" phase and the following possible movement.

Figure 6:
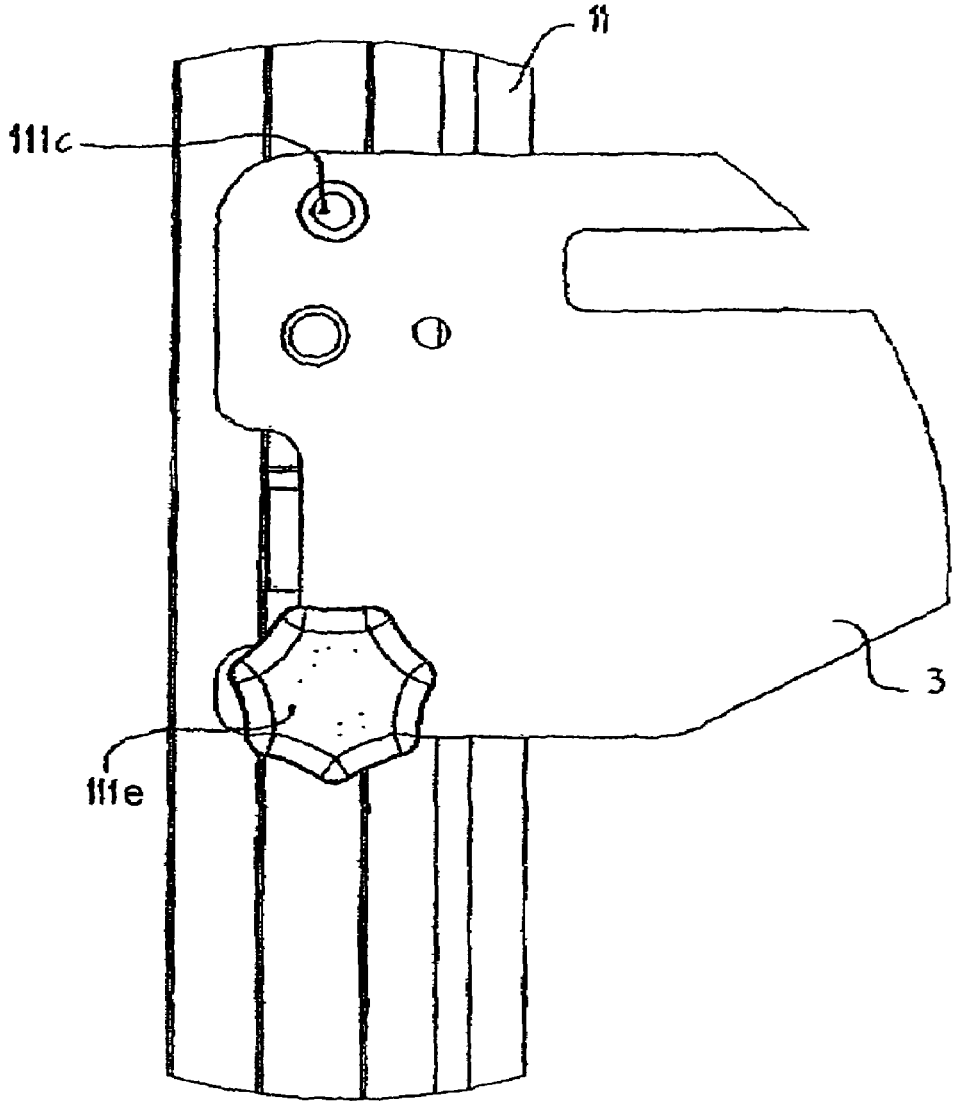
FIG. 6 is a side view depicting the fastening device and the blocking device of the subject system.

FIG. 6 provides a view of the internal part of the bracket 3, showing the knob 111*e* for the "blocking" and "unblocking" of the kinematic motion shown in preceding figures and achieving the system that is the subject of the present invention.

Clearly, the described system which is the subject of the present invention is applicable to all possible types of shelving, for example, shelving units in supermarkets, exhibitions, household furniture of all kinds and type, whether they may be wardrobes or cupboards, and also in electric household appliances, in general, such as refrigerators, and wherever the system could be applied.

It is well understood that numerous variations can be applied to the system which is the subject of the present invention, through equivalent means not only but to their conformance, let alone to the systems and means of connection, rotation, movement, etc., of the elements comprising the aforementioned system.

These and other variations as mentioned above may well be made, however, without leaving the scope of the above description and subsequently claimed and hence the domain protection for the present industrial patent right.

What is claimed is:

1. A device for moving, adjusting and securing a shelf unit, comprising:

the shelf unit;

a pair of brackets for supporting the shelf unit; and a pair of vertical struts for supporting the brackets, wherein each of the vertical struts includes a rack having teeth located at a back part of the vertical strut, and wherein each of the brackets includes:

a small stop for rotating of the bracket within the groove of vertical strut;

a toothed wheel having teeth, the teeth of the toothed wheel being rotationally engagable with the teeth of the rack of a respective one of the vertical struts; and a sliding block having teeth, the teeth of the sliding block being engagable with the teeth of the rack of the respective one of the vertical struts, wherein when the bracket is fixed in a stationary position with respect to the respective one of the vertical struts, the teeth of the toothed wheel and the teeth of the sliding block are engaged with the teeth of the rack and the small stop is in contact with a front part of the respective one of the vertical struts, and when the bracket is adjusted with respect to the respective one of the vertical struts, the teeth of the toothed wheel are engaged with the teeth of the rack and the teeth of the sliding block are disengaged from the teeth of the rack.

2. The device according to claim 1, wherein each of the brackets further includes:

a screw hole positioned therein that is adjacent to the front end of the respective one of the vertical struts when the bracket is fixed in the stationary position; and a screw adjustably insertable in the screw hole, wherein when the screw is extended though the screw hole while the bracket is fixed in the stationary position, the bracket is prevented from being adjusted.

3. The device according claim 2, wherein, for each bracket, the toothed wheel is located between the small stop and the sliding block and the sliding block is located between the toothed wheel and the screw hole in a direction of movement of the bracket along the respective one of the vertical struts during adjustment of the bracket.

4. The device according to claim 1, wherein, for each bracket, the toothed wheel is located between the small stop and the sliding block in a direction of movement of the bracket along the respective one of the vertical struts during adjustment of the bracket.

5. The device according to claim 1, wherein each of the brackets further includes means for preventing the adjustment of the bracket with respect to the respective vertical strut.

* * * * *